US009593513B2

(12) United States Patent
Higgins

(10) Patent No.: US 9,593,513 B2
(45) Date of Patent: Mar. 14, 2017

(54) LOCK RELEASE APPARATUS

(71) Applicant: Toyota Motor Engineering & Manufacturing North America, Inc., Erlanger, KY (US)

(72) Inventor: Christopher Michael Higgins, Ypsilanti, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 234 days.

(21) Appl. No.: 14/170,589

(22) Filed: Feb. 1, 2014

(65) Prior Publication Data

US 2015/0218853 A1 Aug. 6, 2015

(51) Int. Cl.
*E05B 3/00* (2006.01)
*E05B 83/26* (2014.01)

(52) U.S. Cl.
CPC ..... *E05B 83/26* (2013.01); *Y10T 292/57* (2015.04)

(58) Field of Classification Search
CPC ..... E05B 79/20; E05B 79/22; E05B 83/16; E05B 83/18; E05B 83/26; E05B 85/10; A45C 13/22; A45C 2013/223; A45F 2005/1053; Y10T 16/459; Y10T 16/469; Y10T 16/4724; Y10T 403/7037; Y10T 403/7015; Y10T 403/32877; Y10T 403/32885; Y10T 403/32951; Y10T 403/32967
USPC ..... 74/500.5–502.6; 292/336.3, 336.5, 347, 292/358, DIG. 27, DIG. 42, DIG. 43, 292/DIG. 63, DIG. 65, 125, 133, 171, 292/141, 225, 235
See application file for complete search history.

(56) References Cited

U.S. PATENT DOCUMENTS

| | | | | |
|---|---|---|---|---|
| 5,277,080 | A * | 1/1994 | Roelle | A47C 1/024 56/10.5 |
| 5,307,707 | A * | 5/1994 | Roelle | A47C 1/024 297/354.1 |
| 5,927,895 | A | 7/1999 | Watanabe | |
| 6,394,511 | B1 | 5/2002 | Lam et al. | |
| 6,832,793 | B2 | 12/2004 | Bingle et al. | |
| D501,784 | S | 2/2005 | Tibbenham et al. | |
| 7,029,138 | B2 | 4/2006 | Tibbenham et al. | |

(Continued)

FOREIGN PATENT DOCUMENTS

| | | | | |
|---|---|---|---|---|
| DE | 19835821 | A1 | 2/2000 | |
| FR | 2964403 | A1 * | 3/2012 | E05B 79/06 |
| JP | 04754349 | B2 | 8/2011 | |

*Primary Examiner* — Alyson M Merlino
(74) *Attorney, Agent, or Firm* — Christopher G. Darrow; Darrow Mustafa PC

(57) ABSTRACT

A lock release apparatus has a handle and a cable. The handle has a gripping portion and a cable receiving portion. The cable, which is capable of a path of movement over the cable receiving portion, has a cable end which is retained within the handle through an opening of the cable receiving portion. The cable receiving portion includes at least one retention portion which is deflectable in response to compressive force and a blocking portion that blocks engagement of the cable with the at least one retention portion. In another aspect, the cable receiving portion includes at least one retention portion, without a blocking portion, where the at least one retention portion is located out of the path of movement of the cable with respect to the handle.

21 Claims, 4 Drawing Sheets

(56) References Cited

U.S. PATENT DOCUMENTS

| | | | | |
|---|---|---|---|---|
| 7,157,026 | B2 | 1/2007 | Tibbenham et al. | |
| 8,317,237 | B1 | 11/2012 | Fannon et al. | |
| 2004/0160760 | A1* | 8/2004 | Tibbenham | B60Q 3/06 362/84 |
| 2004/0163487 | A1 | 8/2004 | Martus et al. | |
| 2012/0280556 | A1* | 11/2012 | Colboch | F16C 1/26 297/85 C |

* cited by examiner

FIG. 5
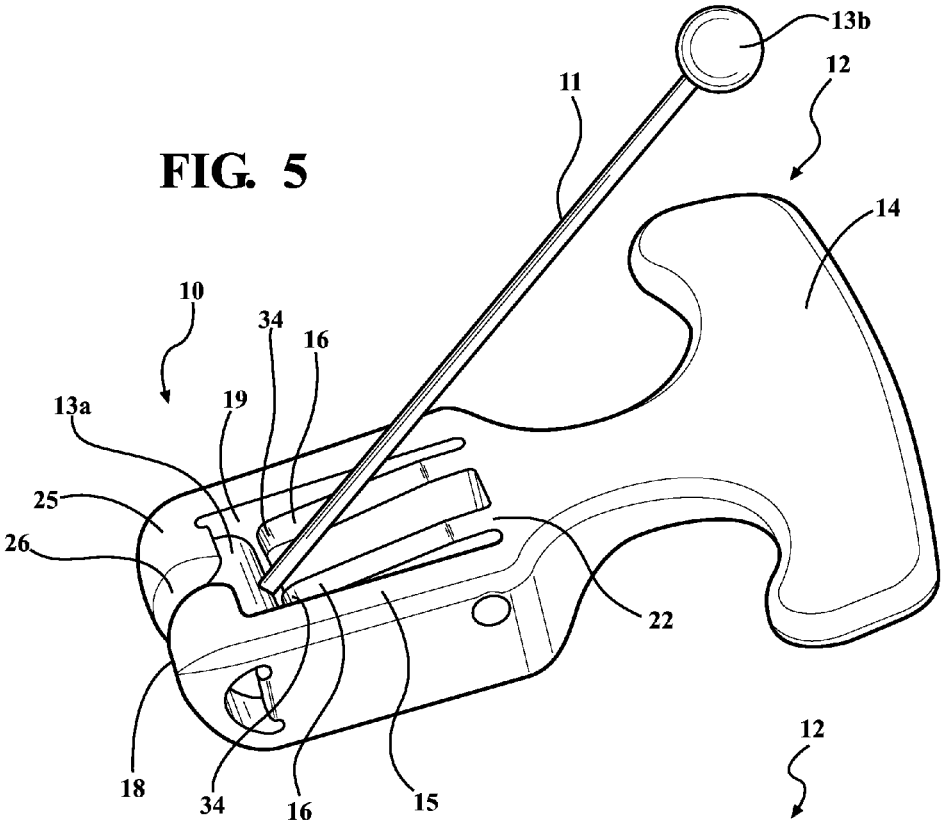
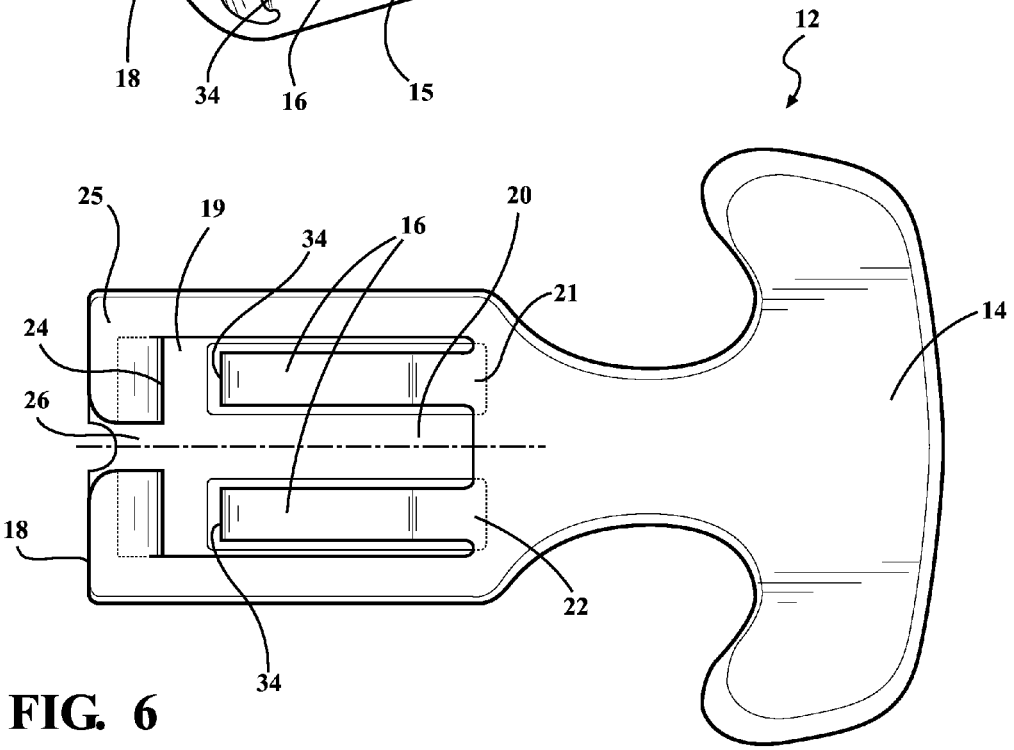
FIG. 6

LOCK RELEASE APPARATUS

BACKGROUND

This disclosure relates generally to a lock release apparatus and, more particularly, to a handle of a vehicle lock release apparatus which allows the trunk to be opened from inside.

Current trunk lock release apparatuses include a handle and a cable located inside the trunk, wherein one end of the cable is attached to a release mechanism within the trunk lock apparatus and the other end of the cable is attached to the handle. When the handle is pulled, tension in the cable is generated which actuates the release mechanism in the trunk lock apparatus, thus opening the trunk from inside.

Current lock release designs employ a low cost, one-piece assembly or a more expensive, two-piece assembly. The one-piece lock release assemblies do not provide the degree of robustness required by current motor vehicles.

It would be desirable to provide a robust handle that retains the other end of the cable in the handle while still allowing easy insertion during assembly.

SUMMARY

The present lock release apparatus is intended to provide a robust handle for the lock release apparatus while having a low cost, one-piece construction and ease of assembly.

According to a first aspect, a lock release apparatus has a handle and a cable. The handle has a gripping portion and a cable receiving portion. The cable, which is capable of a path of rotational movement over the cable receiving portion, has a cable end which is retained within the handle. The cable receiving portion includes at least one retention portion which is deflectable in response to compressive force, and a blocking portion blocking engagement of the cable with the at least one retention portion.

The cable receiving portion includes an aperture at an end for receiving the cable. The blocking portion is aligned with the aperture in the path of movement of the cable.

The cable receiving portion also includes a handle end portion for supporting the cable end in the handle. The cable receiving portion is formed such that a first distance between an inner surface of the handle end portion and an end of the blocking portion is longer than a second distance between the inner surface of the handle end portion and the end of the at least one retention portion.

The at least one retention portion can include a pair of retention portions with the blocking portion disposed between the pair of retention portions.

The blocking portion is positioned for blocking the cable when the cable rotates with respect to the handle.

According to second aspect of the lock release apparatus, a handle has a gripping portion and a cable receiving portion including an opening. The cable receiving portion has at least one retention portion which is deflectable in response to compressive force. A blocking portion formed in the cable receiving portion blocks engagement of the cable with the at least one retention portion.

The cable receiving portion includes an aperture at an end of the cable receiving portion for receiving the cable end. The blocking portion is aligned with the aperture in the path of rotational movement of the cable.

The cable receiving portion also includes a handle end portion for supporting the cable end in the handle. The handle end portion is formed such that a first distance between an inner surface of the handle end portion and the end of the blocking portion is longer than a second distance between the inner surface of the handle end portion and the end of the at least one retention portion. The at least one retention portion can be angled downward relative to the blocking portion.

The at least one retention portion can include a pair of retention portions in this aspect. The blocking portion is disposed between the pair of retention portions.

According to third aspect of the lock release apparatus, the lock release apparatus has latchable elements which are carried on a closure panel of a vehicle for releasibly latching the closure panel in a closed position on the vehicle. The lock release apparatus has a handle and a cable located inside of the closure or trunk. The handle has a gripping portion and a cable receiving portion including an opening. The cable has a cable end, wherein an opposite end of the cable is adapted to be attached to a release mechanism in a vehicle luggage compartment and the cable end is attached to the cable receiving portion of the handle. The cable receiving portion can have one or at least two retention portions, which are deflectable in response to compressive force, and a blocking portion disposed between the one or at least two retention portions for blocking the engagement of the cable with the retention portions when the cable rotates with respect to the handle.

In another aspect, a lock release apparatus has a handle and a cable. The handle has a gripping portion and a cable receiving portion. The cable, which is capable of a path of rotational movement over the cable receiving portion, has a cable end which is retained within the cable receiving portion of the handle. The cable receiving portion includes at least one retention portion or member which is deflectable in response to compressive force allowing insertion of the cable end into the cable receiving portion. The at least one retention portion is disposed out of the path of movement of the cable so as not to interfere with movement of the cable or be moved by contact with the cable to a position which may allow separation of the cable end from the cable receiving portion of the handle.

Other applications of the present invention will become apparent to those skilled in the art when the following description of the contemplated for practicing the invention is read in conjunction with the accompanying drawings.

BRIEF DESCRIPTION OF THE DRAWINGS

FIG. 5 is a perspective view of another aspect of an interior trunk release apparatus, similar to the interior trunk release apparatus shown in FIGS. 1A-4B but containing modifications; and FIG. 6 is a plan view of the handle shown in FIG. 5.

DETAILED DESCRIPTION

Figure 1A:
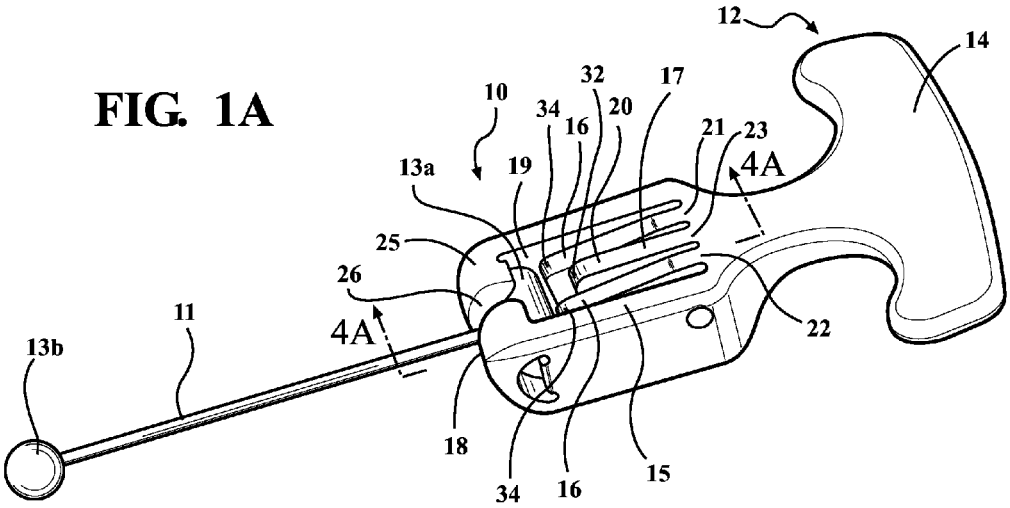
FIG. 1A is a perspective view of one aspect of an interior trunk lock release apparatus.
Figure 1B:
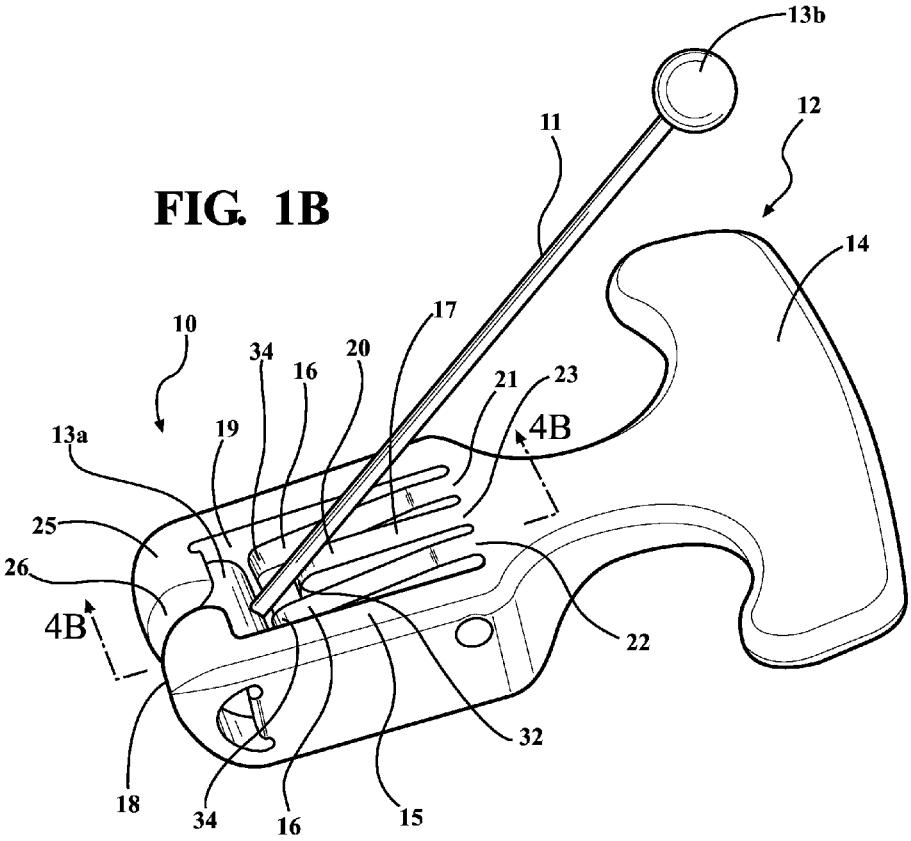
FIG. 1B is a perspective view of the aspect of an interior trunk lock release apparatus shown in FIG. 1A where the blocking portion blocks the cable when the cable rotates with respect to the handle.
Figure 2:
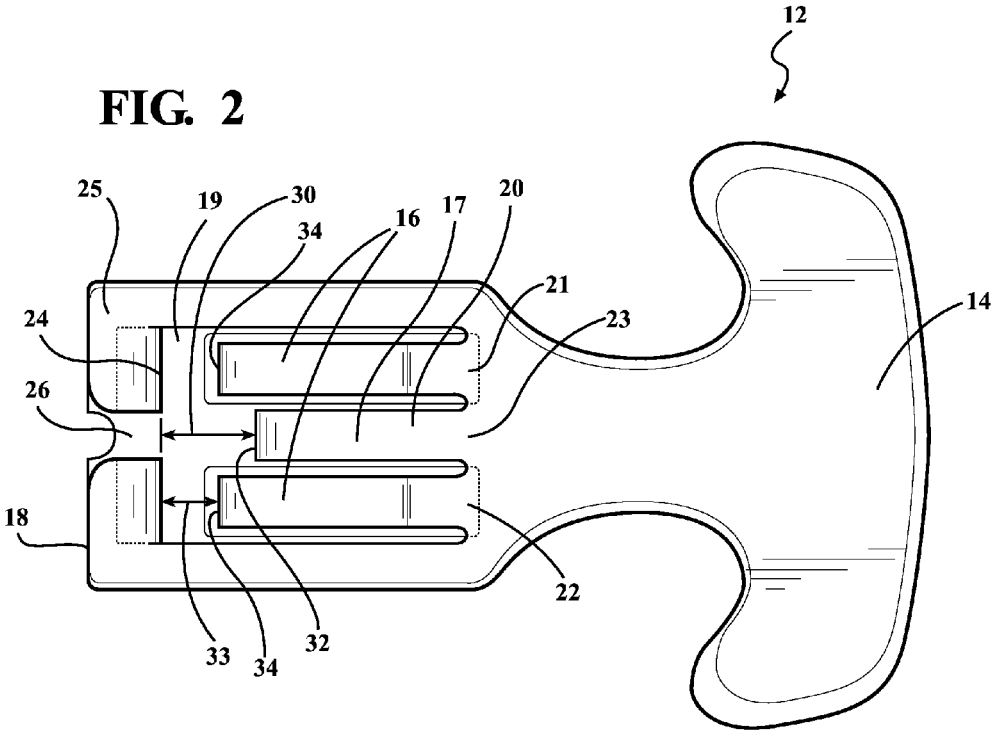
FIG. 2 is a plan view of the handle shown in FIG. 1A.

Referring to FIGS. 1A, 1B and 2, a lock release apparatus 10 has a cable 11 and a handle 12. The cable 11 has a cable right end 13*a* and a cable left end 13*b* in the orientation of the cable 11 in FIGS. 1, 4A and 4B. The cable right end 13*a* is cylindrical end perpendicular to the direction of the cable 11. The cable left end 13*b* is like a sphere which is attached to the latch mechanism (not shown). The handle 12 has a gripping portion 14 in the form of a generally T-shaped trunk release handle and a cable receiving portion 15.

The cable receiving portion 15 has at least one or, as shown by example, a pair of retention portions 16, a blocking portion 17 and a handle end portion 18. The cable receiving portion 15 also has an opening 19 near the handle end portion 18 and the cable right end 13*a* of the cable 11 can be inserted into the opening 19. The retention portions 16 are elastically deflectable in response to compressive force and may be angled downward below an outer surface 20 of the blocking portion 17. One of the retention portions 16 extends from a first point 21 toward the opening 19 of the cable receiving portion 15. The other of the retention portions 16 extends from a second point 22 toward the opening 19 of the cable receiving portion 15. The first point 21 and the second point 22 may be located near an end of the opening 19 at the gripping portion 14 side.

The blocking portion 17 can be disposed between the pair of the retention portions 16 and is not elastically deflectable or movable in response to compressive force. The blocking portion 17 extends from a third point 23 which is located between the first point 21 and the second point 22 and near an end of the opening 19 at the gripping portion 14 side toward the opening 19.

The handle end portion 18 is located at end of the handle 12 for supporting the cable right end 13*a* in the handle 12. The handle end portion 18 can include, for example, an arc-like an inner surface 24 and an outer surface 25 corresponding to a shape of the cable right end 13*a* or any other shape. The handle end portion 18 has an aperture 26 for receiving the cable 11. Once the cable right end 13*a* is inserted through the opening 19, the cable 11 is stored in the aperture 26. The cable 11 is rotatable with respect to the handle 12 through the aperture 26 until it contacts the blocking portion 17.

Figure 3:
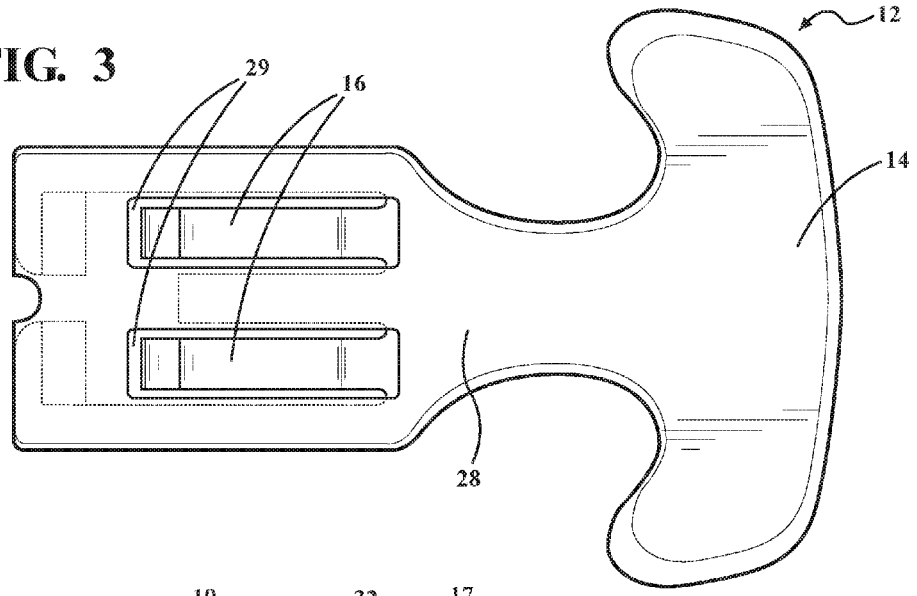
FIG. 3 is a bottom view of the handle shown in FIG. 1A.

Referring to FIG. 3, a back wall 28 of the handle 12 has a pair of back apertures 29 corresponding to the pair of the retention portions 16. The back apertures 29 allow the retention portions 16 to bend without restriction through the back wall 28 of the handle 12 during insertion of the cable right end 13*a*.

Figure 4A:
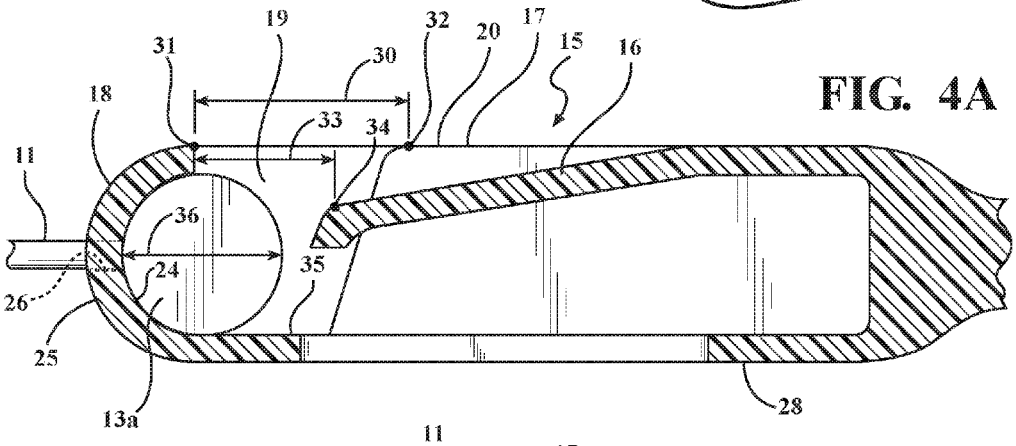
FIG. 4A is cross section view generally along line 4A-4A of FIG. 1A in which the cable is disposed in a normal position.
Figure 4B:
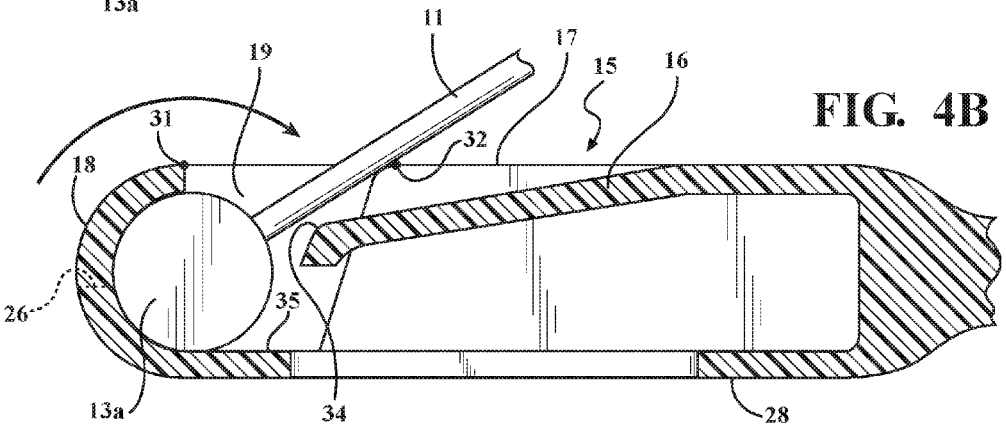
FIG. 4B is cross section view generally along line 4B-4B of FIG. 1B which shows the intersection of the cable and the blocking portion for blocking the cable when the cable rotates with respect to the handle as seen in FIG. 1B.

Referring to FIG. 2, FIG. 4A and FIG. 4B, the cable receiving portion 15 is formed such that a first distance 30 between an upper edge 31 of the inner surface 24 of the handle end portion 18 and an upper edge 32 of the blocking portion 17 is longer than a second distance 33 between the upper edge 31 of the inner surface 24 of the handle end portion 18 and an upper edge 34 of the end of the retention portions 16. For example, both the first and second distances 30, 33 are a horizontal distance relative to a bottom surface 35 of the cable receiving portion 15.

The cable right end 13*a* has a diameter 36. The cable receiving portion 15 is formed such that the diameter 36 of the cable right end 13*a* is smaller than the first distance 30. For this reason, the cable right end 13*a* can be inserted easily through the opening 19 in the cable receiving portion 15 because the cable right end 13*a* will not interfere with the blocking portion 17 during insertion. On the other hand, the cable receiving portion 15 is formed such that the diameter 36 of the cable right end 13*a* is larger than the second distance 33. For this reason, once the cable right end 13*a* is stored in the cable receiving portion 15, the retention portions 16 retain the cable right end 13*a* in the handle 12.

The cable receiving portion 15 maybe formed such that a height of the upper edge 32 of the blocking portion 17 from the bottom surface 35 of the cable receiving portion 15 is higher than that of the upper edge 34 of the retention portions 16. That is, the cable receiving portion 15 may be formed such that at least one portion of the retention portions 16 is angled below an outer surface 20 of the blocking portion 17.

Referring to FIG. 4A and FIG. 4B, the cable 11 in FIG. 4A is disposed in a normal position and the cable 11 in FIG. 4B is shown interacting with the blocking portion 17. Therefore, the blocking portion 17 prevents contact of the cable 11 with, and movement of, the retention portions 16.

During assembly of the cable 11 to the handle 12, the retention portions 16 are bent in response to a compression force as the cable right end 13*a* is inserted under force into the opening 19 and the cable receiving portion 15 is opened up. The cable right end 13*a* is inserted into the opening 19 in the cable receiving portion 15 while the compression force exists. After the cable right end 13*a* is stored in the cable receiving portion 15, the retention portions 16 return to the normal position due to elastic force and retain the cable right end 13*a* in the handle 12. In addition, once the cable right end 13*a* is stored in the cable receiving portion 15, the retention portions 16 remain in a normal position since the cable 11 cannot engage and move the retention portions 16 due to the blocking portion 17 and thereby keep retaining the cable right end 13*a*.

Referring now to FIGS. 5 and 6, there is depicted another aspect of the lock release apparatus 10 in which the cable 11 and the handle 12 are substantially identical to the cable 11 and handle 12 described above and shown in FIGS. 1A-4B.

The handle 12 is a one piece handle, including the one or more retention portions 16. The one or more retention portions 16 are contained substantially within the periphery of the handle 12.

In this aspect of the lock release apparatus 10, the blocking portion 17 is removed. This provides an open space between the pair of retention portions 16 to provide a non-interference path of movement of the cable 11 with respect to the retention portions 16 in all positions of the cable 11, as shown in FIG. 5. This prevents the cable 11 from contacting and moving the one or more retention portions 16 which could interfere with the function of the retention portions 16 in retaining the cable right end 13*a* in the cable receiving portion 15 of the handle 12.

It should be noted that the cable right end 13*a* does not require the cable 11 to be centered between the ends of the cable right end 13*a*. The attachment point of the cable 11 to the cable right end 13*a* maybe off center of the cable right end 13*a*. In this instance, the single retention portion 16 or the pair of retention portions 16 are arranged within the handle 12 so as to be located out of the path of movement of the cable 11.

The lock release apparatus 10 thus provides a robust handle 12 that retains the cable right end 13*a* in the handle 12 while still allowing easy insertion during assembly of the cable 11 to the handle 12.

While the lock release apparatus 10 has been described in connection with what is presently considered to be the most practical, it is to be understood that the lock release apparatus 10 is not be limited to the disclosed aspects but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A lock release apparatus comprising:

a cable having a cable end; and a handle having a gripping portion and a cable receiving portion, the cable receiving portion including:

an opening through which the cable end is insertable, and an inner surface and at least one deflectable retention portion together framing the opening, the at least one deflectable retention portion, together with the inner surface, retentively supporting the cable by its cable end for rotation with respect to the handle through a path movement through the opening, wherein the at least one deflectable retention portion is disposed out of the cable's path of movement when the cable is rotated with respect to the handle.

2. The lock release apparatus of claim 1 wherein the cable receiving portion further includes a blocking portion disposed in the cable's path of movement.

3. The lock release apparatus of claim 2 wherein the blocking portion is configured to block engagement of the cable with the at least one deflectable retention portion when the cable is rotated with respect to the handle through its path of movement.

4. The lock release apparatus of claim 3 wherein:

the cable receiving portion includes a handle end portion defining the inner surface and an upper edge of the inner surface, with the upper edge opposing an end of the blocking portion and an end of the at least one deflectable retention portion; and a first distance between the upper edge and the end of the blocking portion is longer than a second distance between the upper edge and the end of the at least one deflectable retention portion.

5. The lock release apparatus of claim 4 wherein a diameter of the cable end is smaller than the first distance and larger than the second distance.

6. The lock release apparatus of claim 2 wherein the at least one deflectable retention portion includes a pair of deflectable retention portions.

7. The lock release apparatus of claim 6 wherein the deflectable retention portions are spaced apart such that the blocking portion is disposed between the pair of deflectable retention portions.

8. The lock release apparatus of claim 2 wherein at least one portion of the at least one deflectable retention portion is angled below an outer surface of the blocking portion.

9. The lock release apparatus of claim 2 wherein the blocking portion is immovably fixed in the handle.

10. The lock release apparatus of claim 1 wherein the handle is a one piece handle.

11. The lock release apparatus of claim 1 wherein the at least one deflectable retention portion is contained substantially within a periphery of the handle.

12. The lock release apparatus of claim 1 wherein the at least one deflectable retention portion is deflectable in response to a compressive force from a normal position, in which the at least one deflectable retention portion, together with the inner surface, retentively supports the cable by its cable end, in a direction common to a direction in which the cable end is insertable though the opening.

13. The lock release apparatus of claim 1 wherein:

the cable receiving portion further includes a back wall underlying the at least one deflectable retention portion, the back wall having at least one back aperture; and the at least one deflectable retention portion is deflectable in response to a compressive force from a normal position, in which the at least one deflectable retention portion, together with the inner surface, retentively supports the cable by its cable end, into the at least one back aperture and through the back wall.

14. A lock release apparatus comprising:

a cable having a cable end having a diameter; and a handle having a gripping portion and a cable receiving portion, the cable receiving portion including:

an opening through which the cable end is insertable, a handle end portion defining an inner surface with an upper edge, a pair of spaced apart deflectable retention portions having ends opposing the upper edge and framing the opening together with the inner surface, the pair of deflectable retention portions deflectable in response to a compressive force from a normal position in which the pair of deflectable retention portions, together with the inner surface, retentively support the cable by its cable end for rotation with respect to the handle through a path movement through the opening, with a distance between the upper edge and the ends of the pair of deflectable retention portions being smaller than the diameter of the cable end, wherein the pair of deflectable retention portions is disposed out of the cable's path of movement when the cable is rotated with respect to the handle, and a blocking portion disposed between the pair of deflectable retention portions in the cable's path of movement, the blocking portion having an end opposing the upper edge, with a distance between the upper edge and the end of the blocking portion being longer than the distance between the upper edge and the ends of the pair of deflectable retention portions, and larger than the diameter of the cable end.

15. The lock release apparatus of claim 14 wherein at least one portion of each of the deflectable retention portions is angled below an outer surface of the blocking portion.

16. The lock release apparatus of claim 14 wherein the blocking portion is immovably fixed in the handle.

17. The lock release apparatus of claim 14 wherein the handle is a one piece handle.

18. The lock release apparatus of claim 14 wherein the pair of deflectable retention portions is contained substantially within a periphery of the handle.

19. The lock release apparatus of claim 14 wherein the pair of deflectable retention portions is deflectable in response to the compressive force from the normal position in a direction common to a direction in which the cable end is insertable though the opening.

20. The lock release apparatus of claim 14 wherein:

the cable receiving portion further includes a back wall underlying the pair of deflectable retention portions, the back wall having a pair of back apertures; and the pair of deflectable retention portions is deflectable in response to the compressive force from the normal position, into the pair of back apertures and through the back wall.

21. The lock release apparatus of claim 14 wherein the blocking portion is configured to block engagement of the cable with the pair of deflectable retention portions when the cable is rotated with respect to the handle through its path of movement.

* * * * *